US005195688A

United States Patent [19]

Clemmons

[11] Patent Number: 5,195,688

[45] Date of Patent: Mar. 23, 1993

[54] WINDING DEVICE FOR A BUOY MARKER

[76] Inventor: Richard G. Clemmons, Rte. 4, Box 416K, Roanoke Rapids, N.C. 27870

[21] Appl. No.: 826,434

[22] Filed: Jan. 27, 1992

[51] Int. Cl.[5] ..... B65H 75/00; B63B 22/18

[52] U.S. Cl. ..... 424/54 R; 441/26

[58] Field of Search ..... 242/54 R, 86.5 R, 86.5 A, 242/106; 441/26

[56] References Cited

U.S. PATENT DOCUMENTS

| | | | |
|---|---|---|---|
| 735,595 | 8/1903 | Sato | 441/26 |
| 1,993,974 | 3/1935 | McVicker | 441/26 X |
| 3,162,395 | 12/1964 | Bray | 242/86.5 A |
| 3,643,886 | 2/1972 | Colton | 242/86.5 A |
| 3,968,954 | 7/1976 | Casco et al. | 242/225 X |
| 4,501,563 | 2/1985 | Johnson et al. | 441/26 X |
| 4,544,364 | 10/1985 | Bankston | 441/26 X |
| 5,087,216 | 2/1992 | Noggle | 441/26 X |

*Primary Examiner*—Daniel P. Stodola

*Assistant Examiner*—John Rollins

*Attorney, Agent, or Firm*—Rhodes, Coats & Bennett

[57] ABSTRACT

A winding device is used for winding a weighted line onto a buoy marker. The winding device includes a receiver sized and shaped to receive and hold the buoy marker. A electric motor operatively connected to the receiver rotates the receiver and causes the line to be wound onto the buoy marker. An actuating means is connected between the electric motor and a source of power for actuating and deactuating the electric motor. The winding device further includes an automatic shut-off means for turning the motor off when the line is wound to a selected extent. The shut-off means comprises a switch actuator mounted adjacent to a switch and positioned to be engaged by a weight attached to the line when the line is reeled to the desired extent. The switch actuator, in turn, engages the switch and moves it to the "off" position upon being contacted by the weight.

12 Claims, 2 Drawing Sheets

WINDING DEVICE FOR A BUOY MARKER

BACKGROUND OF THE INVENTION

The present invention relates generally to winding devices, and more particularly to a winding device adapted to hold and rotate a fisherman's buoy marker to wind a line onto the buoy marker.

In recent years, sophisticated electronic devices have been made to enable fisherman to locate underwater structures which are likely to be habituated by fish. When such underwater structures are located, the fisherman places a buoy marker on the surface of the water at the location of the underwater structure. The buoy marker is connected to line having a weight at one end. When the buoy marker is placed in the water, the weight causes the buoy marker to rotate thereby unwinding the line and allowing the weight to sink to the bottom.

There are several types of buoy markers currently on the market. The type most commonly used includes a generally H-shaped body having a pair of side members which are connected by a central portion. The line is connected to and wound around the central portion. One problem with this design, as well as other designs, is that there is no easy way to rewind the line onto the buoy marker. In the past, this has been done manually by holding one side of the buoy in one hand and wrapping the line about the central portion of the buoy with the other hand. This method has numerous drawbacks. First, the line is always wet from being in the water and is therefore unpleasant to handle, particularly when it is cold. Further, winding the line in by hand is a relatively slow and tedious process, particularly when a large number of buoys are involved. The amount of time needed to manually rewind a large number of buoys is particularly disadvantageous in the highly competitive tournament fishing industry. Much time is wasted rewinding buoy markers which could otherwise be spent more productively.

SUMMARY AND OBJECTS OF THE INVENTION

The present invention overcomes some of the disadvantages of the prior art buoy markers by providing an automatic winding device for rewinding the line onto the buoy marker. The winding device includes an electric motor which is connected to a receiver. The receiver is adapted to receive and hold the buoy marker. Upon actuation of the motor, the receiver and buoy marker contained therein are rotated thereby causing the line to be wound onto the central portion of the buoy marker. A guide is provided for guiding the line as it is wound onto the buoy marker. The present invention also includes a shut-off means for automatically turning the motor off when the line is reeled to a desired extent. More particularly, the shut-off means includes a switch actuator which is contacted by the weight at the end of the line. Upon contact by the weight, the switch actuator moves the switch to the "off" position. Accordingly, the winding device of the present invention can be left unattended after it is actuated so that other tasks can be performed.

Based on the foregoing, it is an object of the present invention to provide an automatic winding device for winding a line onto a buoy marker.

Another object of the present invention is to provide an automatic winding device for a buoy marker which will shut-off automatically when the line is wound to a desired extent.

Another object of the present invention is to provide a winding device for a buoy marker which is reliable and of a durable construction.

Another object of the present invention is to provide a buoy marker which is relatively simple in construction and easy to manufacture.

Other objects and advantages of the present invention will become apparent and obvious from a study of the following description and the accompanying drawings which are merely illustrative of such invention.

DETAILED DESCRIPTION OF THE INVENTION

Figure 1:
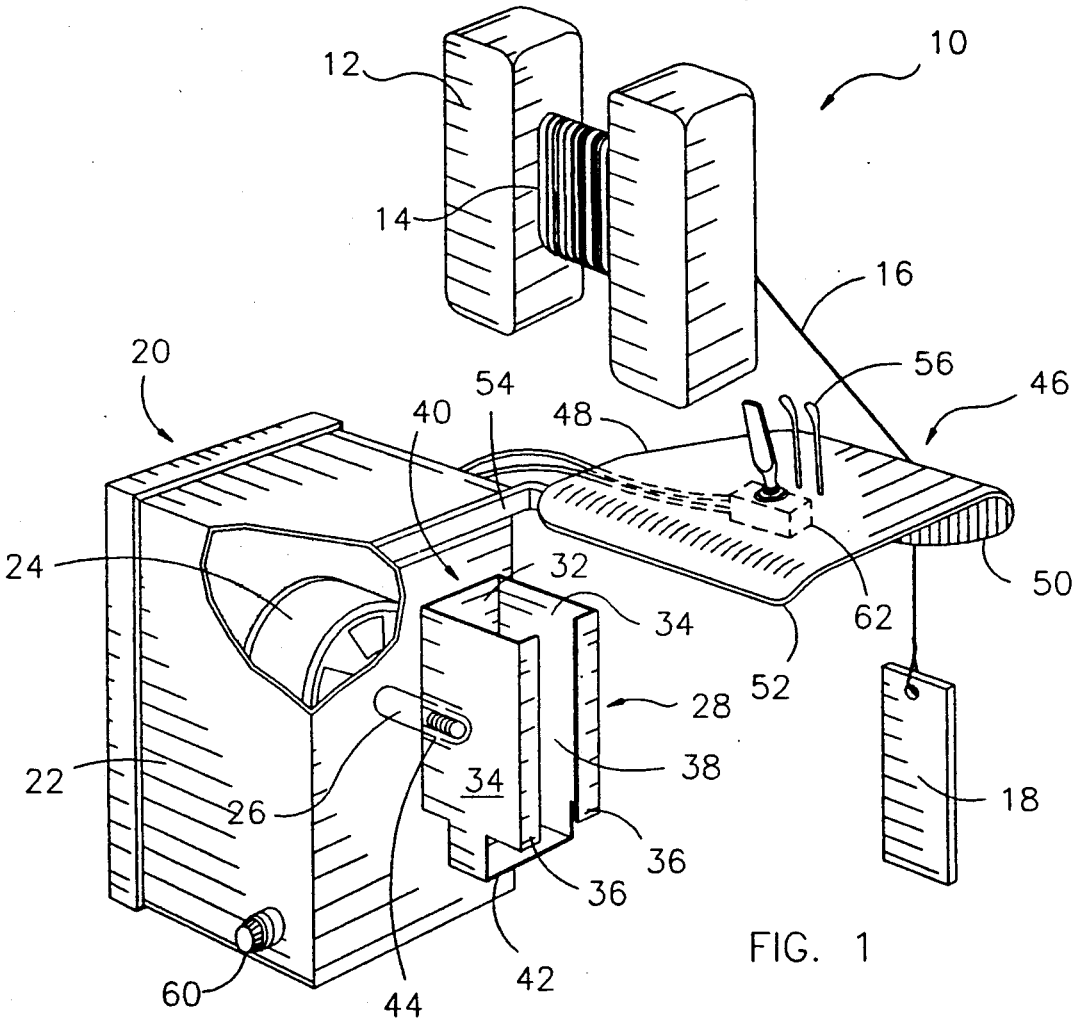
FIG. 1 is a perspective view of the winding device of the present invention.
Figure 2:
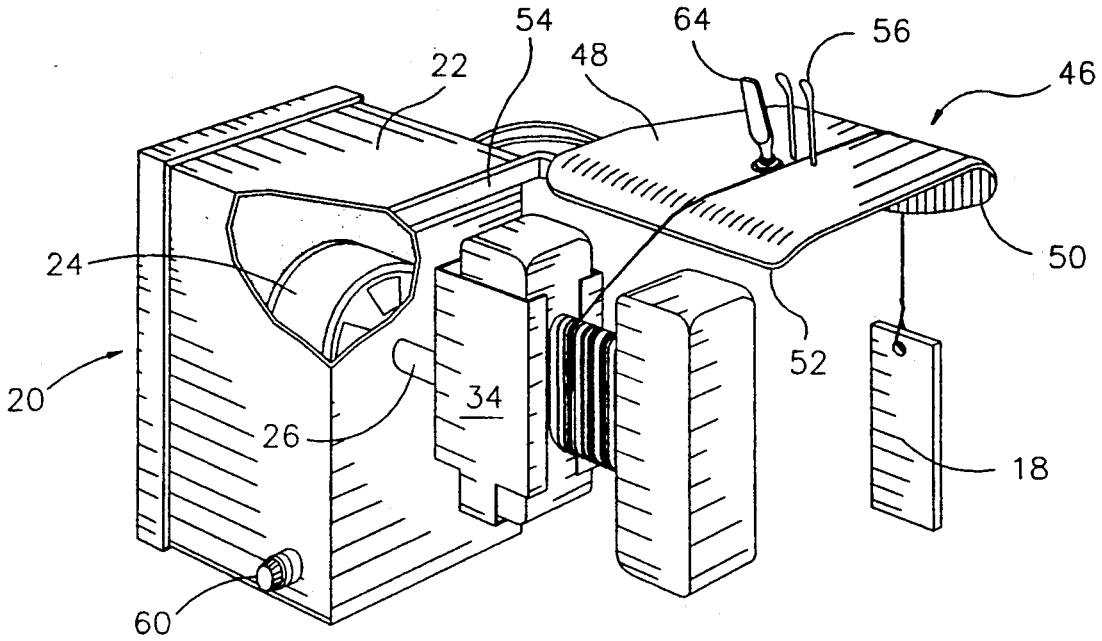
FIG. 2 is a perspective view of the winding device showing the buoy marker inserted into the buoy receiver.

Referring now to the drawings, and particularly to FIGS. 1 and 2, the winding device of the present invention is shown therein and indicated generally by the numeral 20. The winding device 20 is specially adapted to wind a line onto a buoy marker indicated generally at 10. The buoy marker 10 comprises a generally H-shaped body having a pair of side members 12 interconnected by a central portion 14. A line 16 is attached to the central portion 14 and has a weight 18 at one end thereof. These types of buoy markers are widely used by fisherman to mark the location of underwater structures which might be desirable fishing spots.

When the buoy marker 10 is placed in the water, the weight sinks causing the buoy marker 10 to rotate and automatically unwind until the weight 18 reaches the bottom. When the buoy marker 10 is retrieved, it is necessary to wind the line 16 back around the central portion 14 of the buoy marker 10. The winding device 20 of the present invention is designed to automatically wind the line 16 back onto the buoy marker 10 and to shut-off automatically when the line 16 is reeled to a desired extent.

The winding device 20 includes a generally rectangular housing 22 made of aluminum or other non-corrosive material. An electric motor 24 is disposed inside the housing 22. The electric motor preferably runs off of 12-volt DC power supply which is commonly used in fishing boats. Since the winding device 20 is intended to be used in aquatic environments, it is preferable that the electric motor 24 be a sealed motor.

The output shaft 26 of the electric motor 24 extends through the side wall of the housing 22. A buoy receiver 28 is attached to the output shaft 26 for receiving the buoy marker 10. Thus, it will be apreciated that when the electric motor 24 is actuated, the buoy marker 10 is rotated and the line 16 can be wound onto the central portion 14 of the buoy marker 10.

In the embodiment shown, the receiver 28 comprises a tubular member 30 has one open end 40 through which the buoy marker is inserted. The opposite end is closed by a cross member 42. The tubular member 30 includes a back wall 32, and a pair of parallel side walls 34. A pair of front flanges 36 are attached to the forward edge of the side walls 34 and define a slot 38 extending from the open end 40 towards the closed end 42. The tubular member 30 is sized to receive one side member 12 of the buoy marker 10 with the central portion 14 of the buoy marker 10 extending through the slot 38 as can be clearly seen in FIG. 2. The tubular member should be shaped and sized to snugly receive the side member 12 of the buoy marker 10.

In a preferred embodiment of the invention, the receiver 28 is detachable from the output shaft 26 so that different types and styles of receivers 28 can be used interchangeably. To make the receiver 28 detachable, the end of the output shaft 26 is threaded. The output shaft 26 screws into a threaded socket 44 on the back wall 32 of the receiver 28. The direction of the thread should permit the receiver 28 to be screwed onto the output shaft 26 in the direction opposite the rotation of the output shaft 26. This will ensure that the receiver 28 will not inadvertently come unscrewed during operation of the motor 24. Moreover, the pull of the line 16 as it is being wound would tend to keep the receiver 28 tightened on the output shaft 26.

The present invention also includes a guide means 46 for guiding the line 16 as it is wound onto the buoy marker 10. The guide means 46 includes a guide plate 48 made of aluminum or other non-corrosive material which is mounted to the housing 22. The guide plate 48 is mounted to a bracket 54 which is welded to the housing 22. The guide plate 48 includes a forward edge 50 and a back edge 52. Both the forward edge 50 and the back edge 52 are preferably curved downward to prevent the edges from scraping against the line 16 as it is wound onto the buoy marker 10.

The guide plate 48 is positioned vertically above the receiver 28 and the line 16 passes over the top of the guide plate 48. The line 16 then angles downwardly from the guide plate 48 towards the buoy marker 10 as seen in FIG. 2. Thus, when the line 16 is wound onto the buoy marker 10, the downward pull on the line 16 will ensure that the line 16 stays in contact with the guide plate 48.

Figure 3:
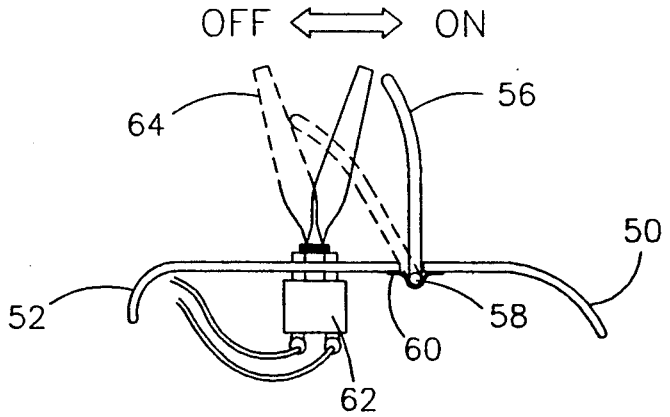
FIG. 3 is an elevation view of the guide plate illustrating the switch and switch actuator.

In addition to the guide plate 48, which maintains the vertical position of the line 16 as it is being wound, the guide means 46 further includes a pair of guide fingers 56 for maintaining the lateral position of the line 16 relative to the buoy marker 10. The guide fingers 56, shown in FIG. 3, are formed from a single piece of bent wire which is pivotally mounted on the guide plate 48. The wire further includes end portions 58 which extend outwardly from the guide fingers 54 beneath the guide plate 48. The guide fingers 56 are inserted upwardly through a pair of openings in the guide plate 48 such that the end portions 58 of the wire engage the bottom of the guide plate 48. The end portions 58 of the wire are then secured to the underside of the guide plate 48 by small metal straps 60 which are welded to the plate 48. The end portions 58 of the wire are loosely held between the metal straps 60 and the bottom of the guide plate 48 so as to permit some pivotal movement of the guide fingers 56 about an axis coincident with the centers of the end portions 58.

The guide fingers 56 project upwardly from the top surface of the guide plate 48 and the line 16 passes between the guide fingers 56. The guide fingers 56 prevent the line 16 from wandering laterally and thereby assures that the line 16 will be wound onto the central portion 14 of the buoy marker 10.

In addition to serving as a lateral guide for the line 16 as it is being wound, the guide fingers 56 also function as a switch actuator. More particularly, an "on-off" switch 62 is mounted on the guide plate 48 adjacent one of the guide fingers 54. The switch 62 is connected between the electric motor 24 and the 12 volt DC power supply. The switch 62 is oriented such that the switch handle 64 extends forwardly towards one of the guide finger 56 when the switch 62 is in the "on" position and extends rearwardly away from the guide fingers 56 when the switch 62 is in the "off" position. When the electric motor 24 is actuated, the line 16 is reeled in and wound around the central portion 14 of the buoy marker 10. When the weight 18 at the end of the line 16 reaches the guide fingers 56, the guide fingers 56 are pushed towards the switch handle 64 by the contact with the weight 18. The guide finger 56, in turn, pushes the switch handle 64 to the "off" position, automatically stopping the motor 24.

To use the winding device 20 of the present invention, the buoy marker 10 is first retrieved from the surface of the water and placed in the receiver 28. The buoy marker 10 is inserted into the receiver 28 by inserting one of the side members 12 into the open end 40 and sliding it downwardly until the buoy marker 10 engages the closed end 42 of the receiver 28. Once the buoy marker 10 is placed in the receiver 28, the line 16 is extended over the top of the guide plate 48 and is placed between the guide fingers 56. The motor 24 is actuated by moving the switch 62 to the "on" position. When the electric motor 24 is actuated, the receiver 28 and buoy marker 10 contained therein is rotated causing the line 16 to be wound onto the central portion 14 of the buoy marker 10. When the line is almost completely reeled in, the weight 18 contacts the guide fingers 56 as previously described, pushing the guide fingers 56 against the switch handle 64. The guide fingers 56 in turn push the switch 62 to the "off" position. Thus, it will be appreciated that once actuated, the winding device 20 of the present invention can be left unattended and will shut-off automatically when the line 16 is wound onto the buoy marker 10. This will enable the fisherman to devote his attention to more productive tasks while the buoy markers 10 are being wound.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A winding device for winding a weighted buoy marker line onto a generally "H-shaped" buoy marker having two leg members attached by a cross-member, comprising:

(a) a housing;

(b) a motor contained within said housing and having an output shaft;

(c) a buoy marker receiver attached to the output shaft of the motor and rotating with the output shaft, the buoy marker receiver having an opening therein sized to receive and frictionally retain one of the leg members of the buoy marker in the buoy marker receiver, such that the buoy marker is rotated about a longitudinal axis of said cross member when the motor is actuated so as to wind the line onto the cross member;

(d) guide means associated with the winding device for guiding the buoy marker line as it is wound onto the buoy marker;

(e) a switch connected between said motor and a source of electrical power moveable between an "on" position and an "off" position;

(f) shutoff means responsive to contact with a shutoff actuator attached to the line for moving the switch from the "on" position.

2. The winding device of claim 1 wherein the shut-off means comprises a switch actuator mounted adjacent to said switch and positioned to be engaged by a weight attached to the line when the line is reeled to a predetermined extent, and which engages said switch to move it to the "off" position upon being contacted by said weight.

3. The winding device of claim 1 wherein the receiver is detachably mounted to the output shaft of the motor.

4. The winding device of claim 1 wherein the guide means includes a guide plate mounted to the housing, said line passing over one side of the guide plate.

5. The device of claim 4 wherein the guide means further includes a pair of guide fingers mounted on said guide plate, wherein the line being wound passes between the guide fingers.

6. The winding device of claim 1 wherein said receiver comprises a tubular member in which one leg member of the buoy marker is received, said tubular member having one open end to receive said one leg member into the receiver, a side wall structure for substantially surrounding said one leg member of the buoy marker, and a slot in said side wall structure extending from the open end of the tubular member to accommodate the cross-member of the buoy marker.

7. The winding device of claim 6 further including guide means for guiding the line as it is wound onto the buoy marker.

8. The winding device of claim 7 wherein the guide means includes a guide plate mounted to the housing, said line passing over one side of the guide plate.

9. The device of claim 8 wherein the guide means further includes a pair of guide fingers mounted on said guide plate, wherein the line being wound passes between the guide fingers.

10. The winding device of claim 6 further including an automatic shut-off means for turning off said motor when the line is reeled to a predetermined extent.

11. The winding device of claim 10 wherein the shut-off means comprises a switch actuator mounted adjacent to said switch and positioned to be engaged by a weight attached to the line when the line is reeled to a predetermined extent, and which engages said switch to move it to the "off" position upon being contacted by said weight.

12. A winding device for winding a weighted buoy marker line onto a generally "H-shaped" buoy marker having two leg members attached by a cross-member, comprising:

(a) a buoy marker receiver sized and shaped to receive and frictionally retain a first leg of the buoy marker, wherein the buoy marker receiver includes an elongated tubular member for receiving and rotating the buoy marker, the elongated tubular member having at least one open end, a side wall structure for substantially surrounding said first leg, and an elongated slot extending through a portion of the sidewall structure for accommodating the cross member;

(b) an electric motor operatively connected to the buoy marker receiver for rotating the buoy marker receiver and buoy marker about a longitudinal axis of said cross member to cause the line to be wound onto the cross-member; and (c) actuating means connected between the electric motor and a source of power for actuating and deactuating the electric motor.

* * * * *